US005339949A

United States Patent [19]

Jensen

[11] Patent Number: 5,339,949

[45] Date of Patent: Aug. 23, 1994

[54] DEVICE FOR CONVEYING ITEMS OF HOUSEHOLD LINEN

[75] Inventor: Jorn M. Jensen, Burgdorf, Switzerland

[73] Assignee: Jensen AG Burgdorf, Burgdorf, Switzerland

[21] Appl. No.: 955,857

[22] PCT Filed: Apr. 14, 1992

[86] PCT No.: PCT/CH92/00070

§ 371 Date: Dec. 14, 1992

§ 102(e) Date: Dec. 14, 1992

[87] PCT Pub. No.: WO92/18682

PCT Pub. Date: Oct. 29, 1992

[30] Foreign Application Priority Data

Apr. 15, 1991 [CH] Switzerland ..... 01119/91

[51] Int. Cl.[5] ..... B65G 47/36

[52] U.S. Cl. ..... 198/803.9; 198/470.1; 198/803.3

[58] Field of Search ..... 198/470.1, 803.3, 803.7, 198/803.9

[56] References Cited

U.S. PATENT DOCUMENTS

| | | | |
|---|---|---|---|
| 2,884,244 | 4/1959 | Bowman | 198/803.7 X |
| 3,122,362 | 2/1964 | Vollrath et al. | 198/803.7 X |
| 4,106,612 | 8/1978 | Koerner | 198/803.3 |
| 4,199,291 | 4/1980 | Winiasz et al. | 198/803.3 X |
| 4,201,286 | 5/1980 | Meier | 198/803.7 X |
| 4,723,770 | 2/1988 | Seidel et al. | 198/803.9 X |

FOREIGN PATENT DOCUMENTS

| | | | |
|---|---|---|---|
| 0341084 | 11/1989 | European Pat. Off. . | |
| 1760596 | 12/1971 | Fed. Rep. of Germany . | |
| 2193107 | 2/1974 | France . | |
| 0112491 | 2/1966 | Netherlands | 198/803.7 |

*Primary Examiner*—James R. Bidwell

*Attorney, Agent, or Firm*—Oblon, Spivak, McClelland, Maier & Neustadt

[57] ABSTRACT

The device for conveying items of household linen comprises two belt-shaped mechanisms, spaced apart from each other transversely to the conveying direction, each rotating along a guideway running essentially in the conveying direction. Attached to each of the belt-shaped mechanisms are holding elements. Items of household linen, which leave a first processing machine via an output conveyor, grasped by the holding elements, are conveyed by rotation of the belt-shaped mechanisms along a lifting segment to the point where they preferably hang freely and are easy to check. Satisfactory items of household linen run through a lowering segment, after the holding elements are turned back via a deflection roller, and are released to a further processing machine via an input conveyor. First, second and third control mechanisms provide for grasping and release of items of household linen. Thus items of household linen judged to be sub-standard can be removed from the processing line through activation of an ejection key which brings in the third control mechanisms via a control unit. With just one operator, items of household linen can be checked comfortably and practically without any fatigue.

9 Claims, 4 Drawing Sheets

DEVICE FOR CONVEYING ITEMS OF HOUSEHOLD LINEN

TECHNICAL FIELD

The present invention concerns a device for conveying items of household linen from a first processing machine to a subsequent processing machine of a textile or laundry processing line.

BACKGROUND ART

The device for conveying items of household linen is preferably employed where a visual control of the items of household linen must be carried out between two processing machines. This could be the case at the exit of a sewing robot, where, for example, linens, in particular fitted sheets, are to be examined as to quality before they are transferred to a subsequent folding robot.

Until now, continuing with the same example, the sheets emitted from the sewing robot fell to the floor where a disorderly pile was formed. One sheet after another was then picked up by two operating personnel, spread out, and checked. When it was considered to be in order, it was placed on an input conveyor of the folding robot which followed the sewing robot. With the rejected goods, a further disorderly pile of sheets was formed. These tasks are time-consuming, tedious and tiring. When carried out over a long period of time, the quality of control suffers.

DISCLOSURE OF THE INVENTION

It is the object of the present invention to offer an improvement in this respect. With a device for conveying items of household linen according to the invention not only should there be less manual work, but the quality of control should be improved and guaranteed over a longer period of time.

This object is fulfilled with the features of the present invention.

BRIEF DESCRIPTION OF THE DRAWINGS

The invention will now be explained more closely, with the aid of an embodiment, with reference to the drawings in which.

BEST MODE FOR CARRYING OUT THE INVENTION

Figure 1:
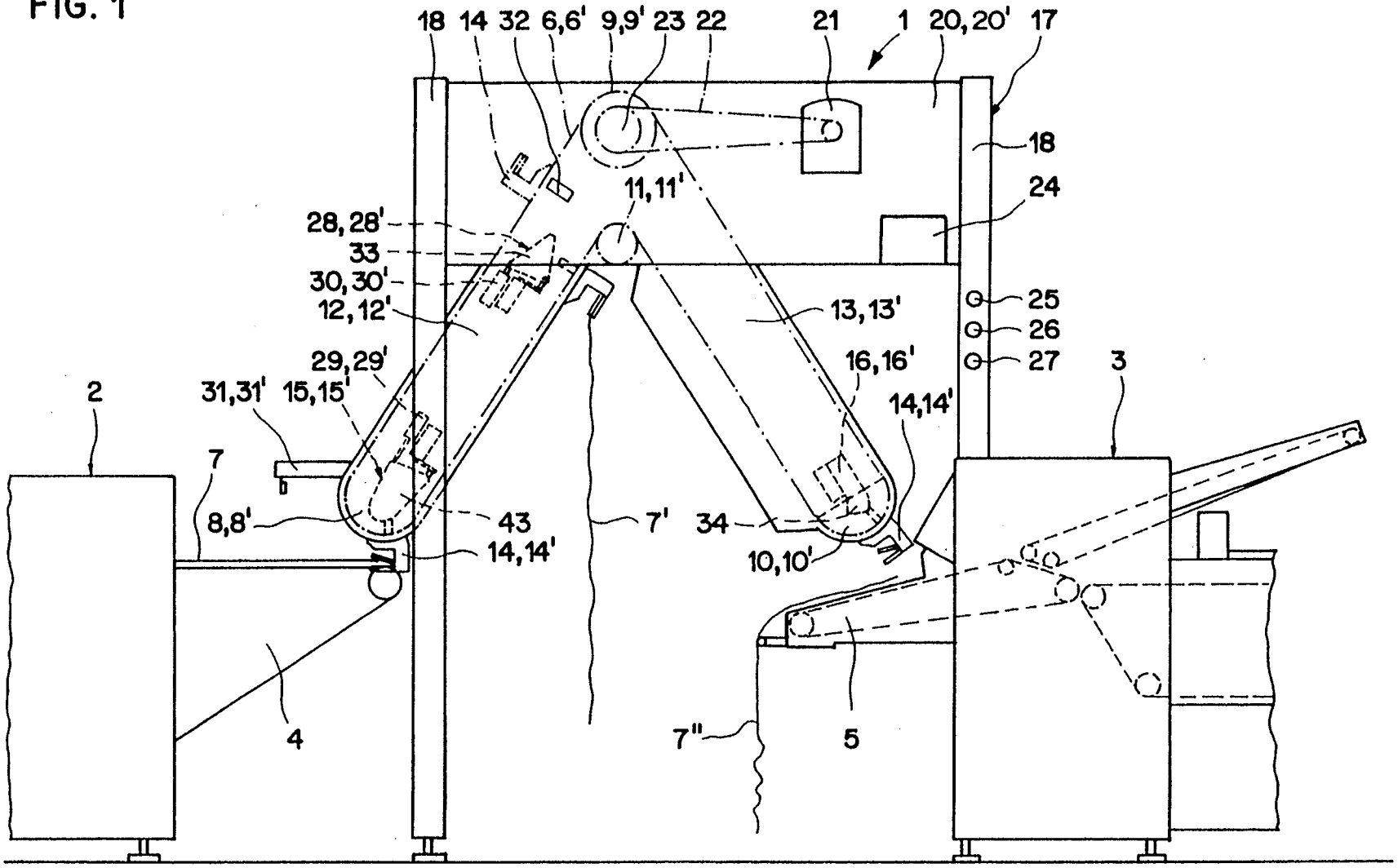
FIG. 1 is a side view of the device for conveying items of household linen according to the invention, arranged in a processing line.
Figure 2:
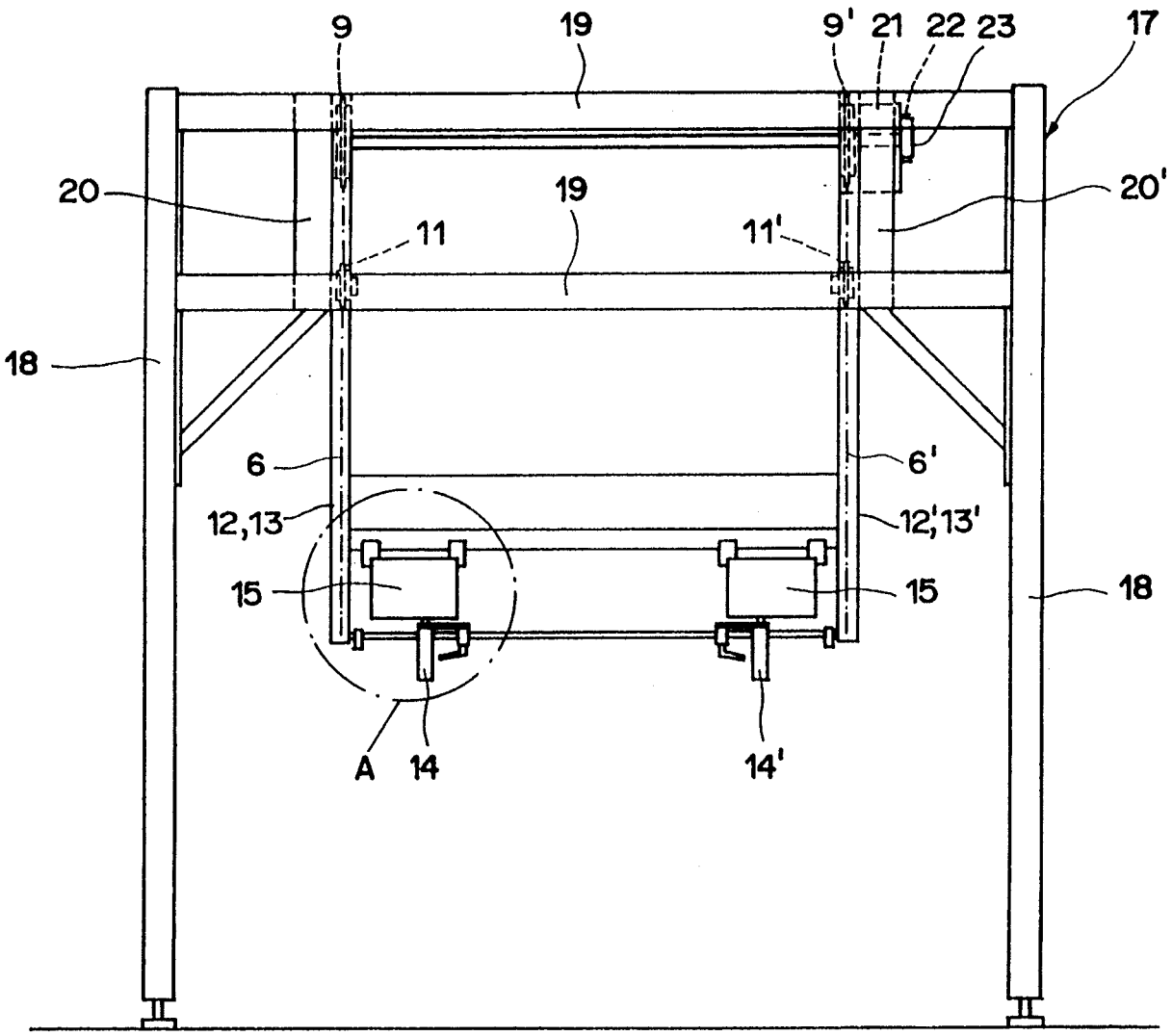
FIG. 2 is a frontal view of the device for conveying items of household linen according to FIG. 1.

In FIG. 1 and 2 the device for conveying items of household linen according to the invention is presented in a side view. FIG. 1 shows moreover the arrangement of the device for conveying items of household linen 1 in a processing line. A first processing machine, for example a sewing robot, is designated with 2. This robot has an output conveyor 4 which outputs bedlinen or clothing articles 7. A second processing machine 3, for example a folding robot, is disposed after the sewing robot at a distance. This machine has an input conveyor 5. Positioned between said two processing machines 2, 3 is a device for conveying items of household linen 1 according to the invention. This device has the task of conveying processed items of household linen 7, which leave the sewing robot 2, in the direction of the folding robot 3. Achieved thereby should be that each item of household linen is brought during conveyance into a position suitable for a visual quality control. The device for conveying items of household linen 1 comprises a frame 17, consisting of four vertical supports 18, which, forming a square, are disposed spaced apart from each other. On their ends turned away from the floor, two each of vertical supports 18 are connected crosswise to the conveying direction with horizontal supports 19. Longitudinally to the conveying direction of the items of household linen, two each of adjacent vertical supports 18 are fixed together with one connecting plate 20, 20' each. An electric motor 21 is disposed on one of these connecting plates 20'. The rpm of the motor can be set or varied. By means of a chain 22 the motor drives a drive wheel 9', which, via a shaft, is connected to a further drive wheel 9 disposed on the connecting plate 20 opposite the motor. Disposed on each of the connecting plates, moreover, is one extension arm 12, 13 or 12', 13', respectively. Each of the two extension arms 12, 13 on the one hand and 12', 13' on the other hand are situated in a V-shape with respect to each other. Mounted on the ends of each of the extension arms 12, 12', 13, 13' turned away from the connecting plates are guide channel pieces 8, 8', 10, 10' for guiding and turning around belt-shaped means 6, 6', for example chains or synchronous belts. Pivotably disposed on each of the connecting plates 20, 20' is one deflection roller 11, 11' each below drive wheel 9, 9'. With drive wheels 9. 9', the anterior guide channel pieces 8, 8' facing sewing robot 2, deflection rollers 11, 11' and the posterior guide channel pieces 10, 10' facing folding robot 3, a guideway is formed for each self-contained belt-shaped means 6, 6'. These chains can be put into circulation by means of drive wheel 9, 9'. Fixed to each of the chains 6, 6', spaced apart from each other transversely to the conveying direction, is at least one holding element 14, 14' each. Preferably there are several of these holding elements 14, 14' along each of the chains 6, 6', with equal spacing from one another. They follow each of the guideways presented by chains 6, 6'. Starting at a ready position in the area of the anterior guide channel pieces 8, 8', holding elements 14, 14', one after the other, pass through a lifting segment 12, 12' of the frontal extension arms facing sewing robot 2, undergo a change of direction via deflection rollers 11, 11', pass through a lowering segment 13, 13' of the lateral extension arms facing the folding robot, undergo a further change of direction through the posterior guide channel pieces 10, 10', and, turned around by drive wheels 9, 9' on the way back, again reach the anterior guide channel pieces 8, 8' in said ready position.

The holding elements 14, 14' are constructed as clips in the embodiment shown. These clips take a predetermined closing position, but can be opened upon need. Control means are foreseen therefor. It is to be noted here that these pieces are described in more detail later on.

The functioning of the device for conveying items of household linen according to the invention will now be explained. To do this we start with the presumption that one holding element 14, 14' on each of the two chains 6, 6' is situated in the ready position. The clips are at essentially the same level as output conveyor 4 of sewing robot 2. First control means 15, 15', which are pivotable by means of a first cylinder 29, 29', ensure that the clips of holding elements 14, 14' are opened in the ready position. Chains 6, 6' are not moving. As soon as an item of household linen 7 leaves sewing robot, this is detected by detection elements 31, 31', disposed above output conveyor 4. Reflection light barriers are preferably used as detection elements. Depending upon the conveying speed, a shorter or longer period of time passes from the moment of detection of an item of household linen by the detection elements until the leading edge of the article is situated between the opened clips of the holding element. This period of time can be set on a control unit 24. After expiry of this time the first cylinders 29, 29' are activated by control unit 24, the first control means 15, 15' thereby pivoted, the clips of holding elements 14, 14' closed and motor 21 switched on. The holding elements, with the item of household linen now grasped, pass through said lifting segment 12, 12' up to a position just in front of deflection rollers 11, 11'. At this point in time further holding elements 14, 14' are situated in the ready position with open clips. Motor 21 is switched off again. The presence of holding elements in the ready position can be ascertained, for example, by means of a proximity switch, disposed at a particular position on the return route of the holding elements. The previously grasped item of household linen 7 is now in a hanging position. It is designated 7'. In this position quality control is carried out by an operator. Should it be determined that the article is sub-standard, the operator actuates a rejection key 25. This has the effect that second cylinders 30, 30' are brought into action by control unit 24, which activate third control means 28, 28' ensuring that the clips of the holding elements of the hanging item of household linen open and the item of household linen 7 is thus let go and removed from the processing line. If the article is not sub-standard, the operator has moreover the possibility to assess the quality by means of several preselection buttons 26, 27. As a result, at the exit of the folding robot, the item of household linen is placed on the corresponding pile of articles of first or second quality, etc. As soon as a further item of household linen 7 is grasped as previously described, the motor is switched on again. Once the quality has been controlled, a hanging item of household linen passes through the lowering segment 13, 13', and reaches the posterior guide channel pieces 10, 10'. Second, fixed control means 16, 16', so-called abutting sheets, ensure that during the turn-about procedure the clips of the holding elements 14, 14' are opened. Consequently the part of the item of household linen grasped by the clips falls on input conveyor 5 of folding robot 3. The item of household linen 7", the back end of which is lying on the floor, is maintained on the input conveyor in way known per se, for instance by means of a vacuum. Thus one item of household linen after another passes from the sewing robot in the hanging position ultimately to the folding robot. In the hanging position quality control can be carried out comfortably and practically without any fatigue by a single operator. The tedious procedure requiring the work of at least two persons to pick up, spread out, and check the items of household linen and then place them on input conveyor 5 of folding robot 3 is omitted. It should be added here that for reasons of safety a torque limiter 23 is disposed between motor 21 and drive wheel 9'.

Figure 3:
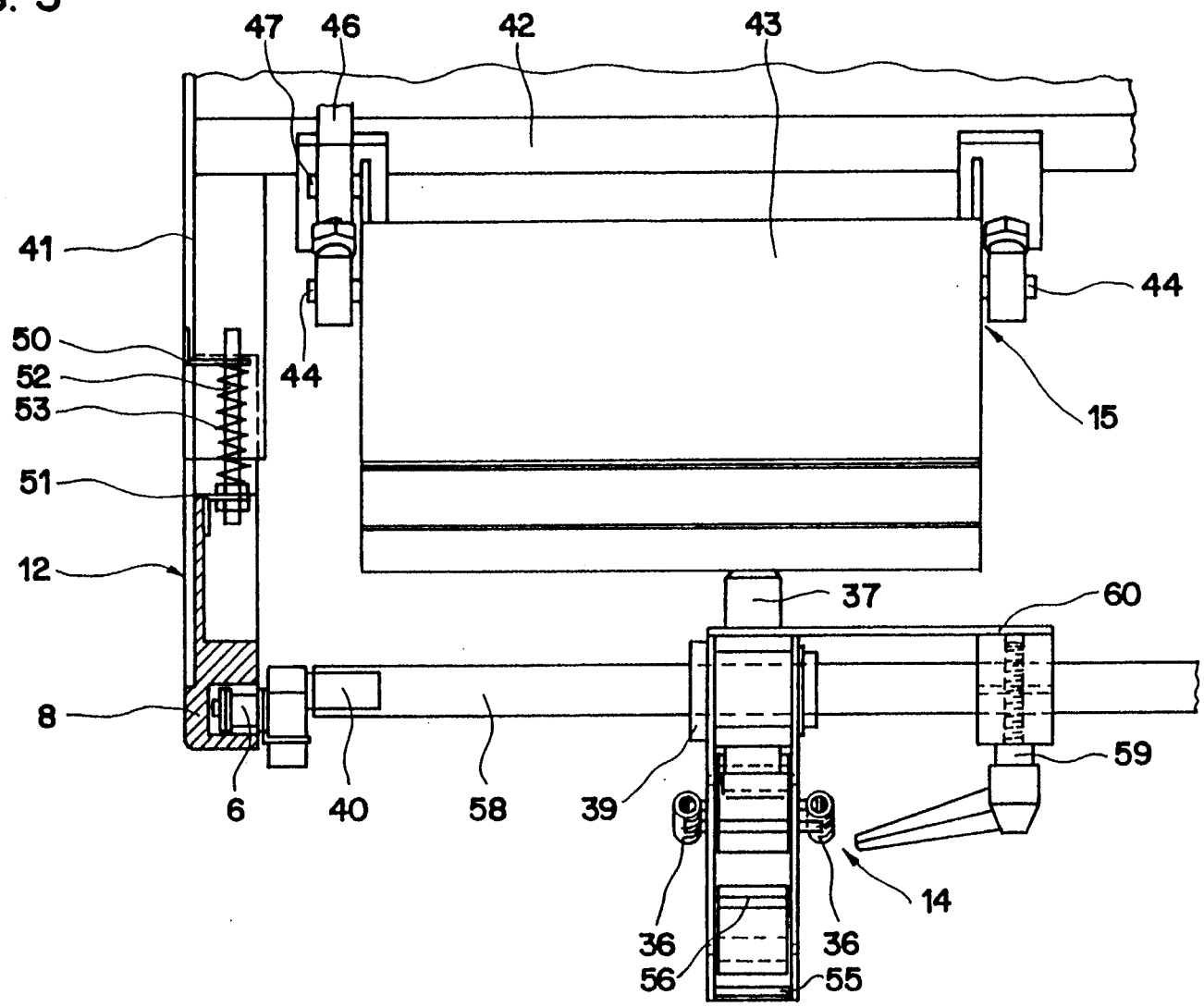
FIG. 3 is an enlargement of the section marked A in FIG. 2, with a holding element and a first control means.
Figure 4:
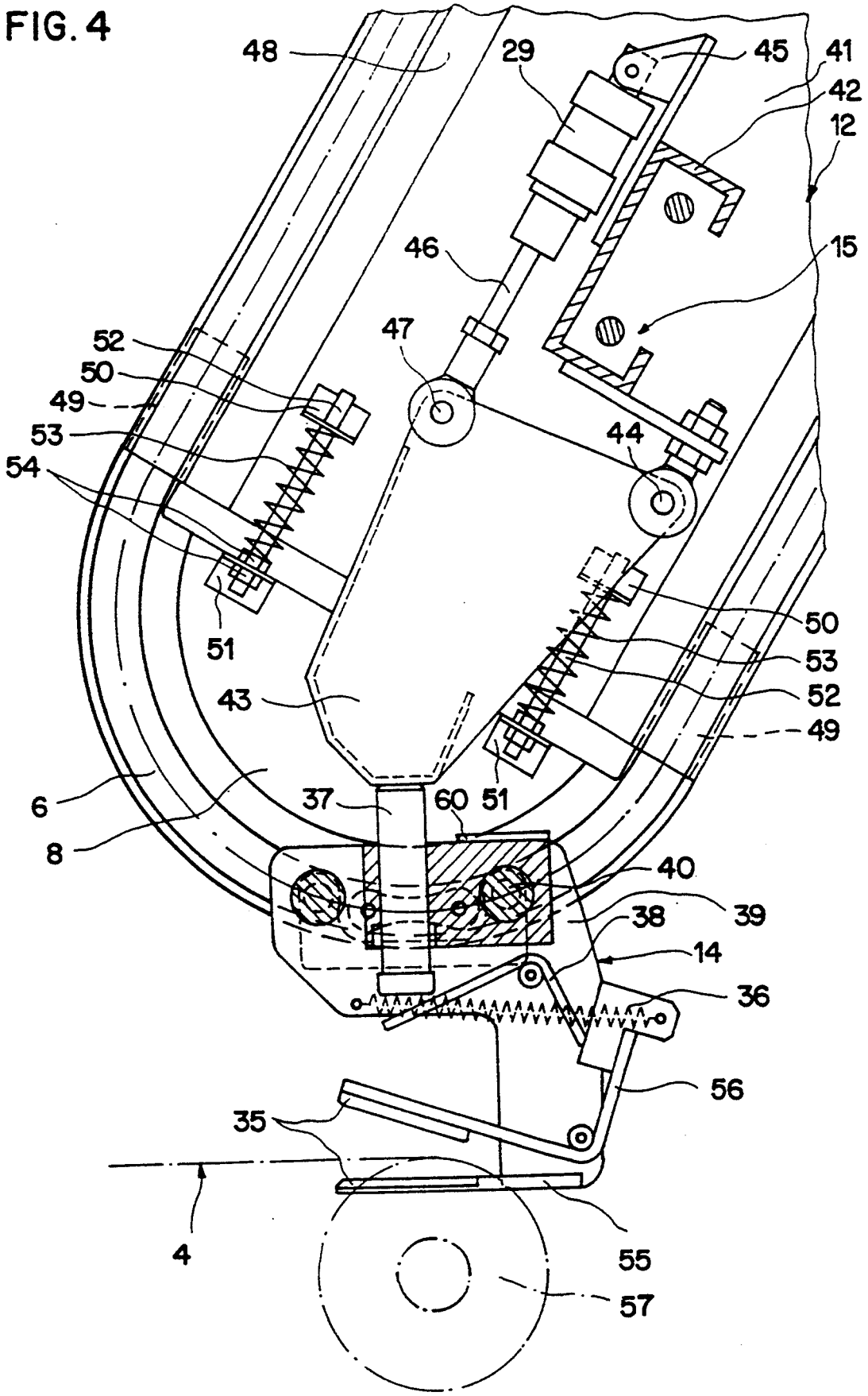
FIG. 4 is a side view of the holding element and of the first control means according to FIG. 3.

Depicted on an enlarged scale in FIG. 3 and 4 are holding element 14 and a first control means 15. First control means 15 corresponds in construction and way of functioning to control means 15', 28, 28'.

FIG. 3 comprises essentially the section designated A in FIG. 2. FIG. 4 shows a side view thereof.

Holding element 14 has a support 39. Disposed on this support is an actuation element 37, 38, consisting of an actuating pin 37 and an actuating knee 38. Support 39 further comprises a clip 35 with a rigid jaw 55 and a swinging jaw 56. A tension spring 36, as an organ which generates a closing effect, ensures that the clip is closed in the case of non-actuation of actuating element 37, 38. By pushing down actuating pin 37, actuating knee 38 is pivoted, a side of actuating knee 38 acts upon a side of likewise angularly designed swinging jaw 56, and pivots the latter in relation to rigid jaw 55 into the open position of clip 35. Actuating pin 37 is actuated by control means 15. Moreover a reinforcement rail 42 is disposed between extension arms 12, 12', each of which is formed essentially of a suitably bevelled profile sheet 41. Pivotably disposed on reinforcement rail 42 is, on the one hand, first cylinder 29, for instance a pneumatic cylinder, by means of a cylinder support. On the other hand, a release mechanism or pivot piece 43 is held on reinforcement rail 42 by means of swivel pins 44, and is pivotably disposed. Piston rod 46 of first cylinder 29 is connected to pivot piece 43 via a further swivel pin 47. Through the actuation of cylinder 29, or the moving in and out of piston pin 46, the pivot piece can be pivoted and either act upon actuating pin 37 of holding element 14 or not. It can be seen from FIG. 3 that support 39 of holding element 14 is displaceably disposed on slide rail 58. It can be shifted transversely to the conveying direction of the item of household linen, stopped and locked by means of a locking device 59, which is connected to support 39 by means of a fastening plate 60. Slide rail 58 is held on both its ends by one supporting pin 40 each, connected to one of the chains 6, 6'. This way it is possible to adjust the position of the holding elements crosswise to the conveying direction of the width of the item of household linen to be conveyed. Pivot piece 43 of first control means 15 is constructed essentially as a channel-shaped profile sheet. The channel extends through the foreseen shifting area of holding element 14. The release mechanisms or pivot pieces 33, 33' of third control means 28, 28' are similarly constructed. This also applies to the design of abutting sheets 34, 34', also serving as the release mechanism, of second control means 16, 16'.

The guide channel pieces 8, 8', 10, 10' are preferably made of plastic for reasons of noise control. The anterior guide channel pieces 8, 8' are disposed preferably displaceable in the longitudinal direction in relation to extension arm 12. By means of angle sections 48 and the bevelled sheet 41, guide channels are formed through which chain 6 runs. An extension 49 of guide channel piece 8 projects into each of these guide channels. By means of angle members 50 disposed on bevelled sheet 41 of extension arm 12 and correspondingly positioned opposite angle members 51 connected to guide channel piece 8, a tensioning of chain 6 can be achieved in that a pressure spring 53 acts between the sides of said angle member 50, 51 protruding from extension arm 12 or from the guide channel piece, respectively. Each of these springs encircles a guide pin 52, which is fixed to the opposite angles by means of nuts 54, for example, and is held shiftably in the sides of angle member 50 projecting from sheet 41.

I claim:

1. A device for conveying items of household linen from a first processing machine to a subsequent processing machine of a textile or laundry article processing line, which comprises:

two belt-shaped mechanisms, spaced apart from each other transversely to the conveying direction, each rotating along a guideway running essentially in the conveying direction, wherein each of the guideways comprises at least one lifting segment and at least one lowering segment, wherein each of the belt-shaped mechanisms has at least one element for holding one of the items of household linen;

a first control mechanism for the holding elements which is provided in the area of the lower end of the lifting segment adjacent to the first processing machine in such a way that said one of the items of household linen leaving the first processing machine is grasped and held by the holding elements, wherein one of the grasped items of household linen is essentially free hanging during passage through the lifting segment, and, during passage through the subordinate lowering segment, is lowered to a predetermined height of the second processing machine;

a second control mechanism for opening the holding elements which is provided approximately at the lower end of the lowering segment adjacent to the second processing machine; and a third control mechanism for opening the holding elements which is disposed along the guideways before the second control mechanism in the conveying direction of said one of the items of household linen, the second control mechanism serving to forcibly permit release of said one of the items of household linen and the third control mechanism serving to release as desired said one of the items of household linen.

2. A device for conveying items of household linen as set forth in claim 1, wherein the holding element comprises a clip with an element for closing effect and has an actuation mechanism for opening the clip.

3. A device for conveying items of household linen as set forth in claim 2, wherein each of the control mechanisms comprises a tripping device for exerting an influence on said actuation mechanism.

4. A device for conveying items of household linen as set forth in claim 3, which comprises a control device for controlling the tripping device.

5. A device for conveying items of household linen as set forth in claim 1, wherein the third control mechanism is disposed essentially at an upper end of the lifting segment.

6. A device for conveying items of household linen as set forth in claim 1, wherein the area of the lower end of the lifting segment at least one detection element is positioned for recognizing a ready item of household linen conveyed to the holding elements.

7. A device for conveying items of household linen as set forth in claim 1, wherein at least one slide rail extends between the two belt-shaped mechanisms, one end each of the slide rail is connected to each of the belt-shaped mechanisms, and wherein each of the holding elements associated with the belt-shaped mechanisms is shiftably disposed on the slide rail.

8. A device for conveying items of household linen as set forth in claim 7, wherein the belt-shaped mechanisms comprise one of chains and synchronous belts, which are driven together by a single motor with an rpm which can be one of being set and varied.

9. A device for conveying items of household linen as set forth in claim 1, which comprises one of a plurality of rollers and a plurality of guide channel pieces which are provided for turning around the belt-shaped mechanisms and wherein at least one guide channel piece each is flexibly and shiftably disposed for tensioning each of the belt-shaped mechanisms.

* * * * *